United States Patent [19]

Pearl

[11] 4,448,808

[45] May 15, 1984

[54] METHOD FOR PREPARING PATTERN PIECE

[75] Inventor: David R. Pearl, West Hartford, Conn.

[73] Assignee: Gerber Garment Technology, Inc., South Windsor, Conn.

[21] Appl. No.: 368,708

[22] Filed: Apr. 15, 1982

[51] Int. Cl.[3] ..... B05D 3/12

[52] U.S. Cl. ..... 427/208.6; 83/925 CC; 427/286; 427/289; 427/290; 427/421

[58] Field of Search ..... 427/285, 286, 289, 290, 427/284, 292, 293, 208.6, 421; 118/37, 697; 156/247; 83/925 CC

[56] References Cited

U.S. PATENT DOCUMENTS 3,320,925 5/1967 Dexter et al. ..... 427/290 X 3,731,648 5/1973 Gerber et al. ..... 118/697

3,830,122 8/1974 Pearl ..... 83/925 CC

*Primary Examiner*—Evan K. Lawrence

*Attorney, Agent, or Firm*—McCormick, Paulding & Huber

[57] ABSTRACT

A pattern piece is prepared by moving a cutting instrument in accordance with a predetermined program and in cutting engagement with sheet material spread on a supporting surface to cut the pattern piece from the sheet material. Simultaneously with the cutting operation, a substance is applied to the sheet material along at least a substantial portion of the outline of the pattern piece. The applied substance may be a marking fluid for outlining the pattern piece to facilitate its separation from adjacent scrap material or adhesive for enabling a pickup surface brought into adhering engagement with the applied adhesive to pickup either the cut pattern piece or the scrap material.

14 Claims, 10 Drawing Figures

METHOD FOR PREPARING PATTERN PIECE

BACKGROUND OF THE INVENTION

This invention relates in general to the preparation of pattern pieces from sheet material and deals more particularly with an improved method for preparing a pattern piece from a single sheet of material or a layup, which comprises a relatively few plies of sheet material, in response to a predetermined cutting program. The present method is particularly adapted for use in the automated cutting of pattern pieces used in the fabrication of custom garments and the like to facilitae manual or automatic separation of each cut pattern piece from the scrap material produced by the cutting operation.

The pattern pieces which comprise the component parts of a custom garment, such as a suit or shirt, are usually cut on an automated machine from a single sheet of material or fabric spread on a cutting table. The cutting tool or blade used to cut the fabric makes an extremely fine kerf or cut which is barely discernible upon completion of the cutting operation, so that it is difficult to distinguish the cut pattern pieces from the surrounding scrap material. Consequently, cut pattern pieces may be overlooked during the separation process and inadvertently discarded with the scrap resulting in loss of valuable material.

It is highly desirable that all pieces used in the fabrication of a single garment be cut from fabric produced in the same dye lot. The loss of one or more pattern pieces which comprise the component parts of a garment may pose a more serious problem when the garment is assembled. The replacement of a lost pattern piece may result in the introduction of a pattern piece from a different dye lot which may be slightly mismatched with the other pattern pieces which comprise the finished garment. The present invention is primarily concerned with the aforedescribed problems.

SUMMARY OF THE INVENTION

In accordance with the present invention a pattern piece is prepared by spreading at least one sheet of material on a supporting surface, moving a cutting instrument in cutting engagement with the spread material in accordance with a predetermined program to cut a pattern piece from the sheet material, and applying adhesive to the sheet material to facilitate its separation from surrounding scrap material. The pattern piece or the scrap material which surrounds it is picked up by moving a pickup surface into adhering engagement with the applied adhesive.

DETAILED DESCRIPTION OF PREFERRED METHODS

Figure 1:
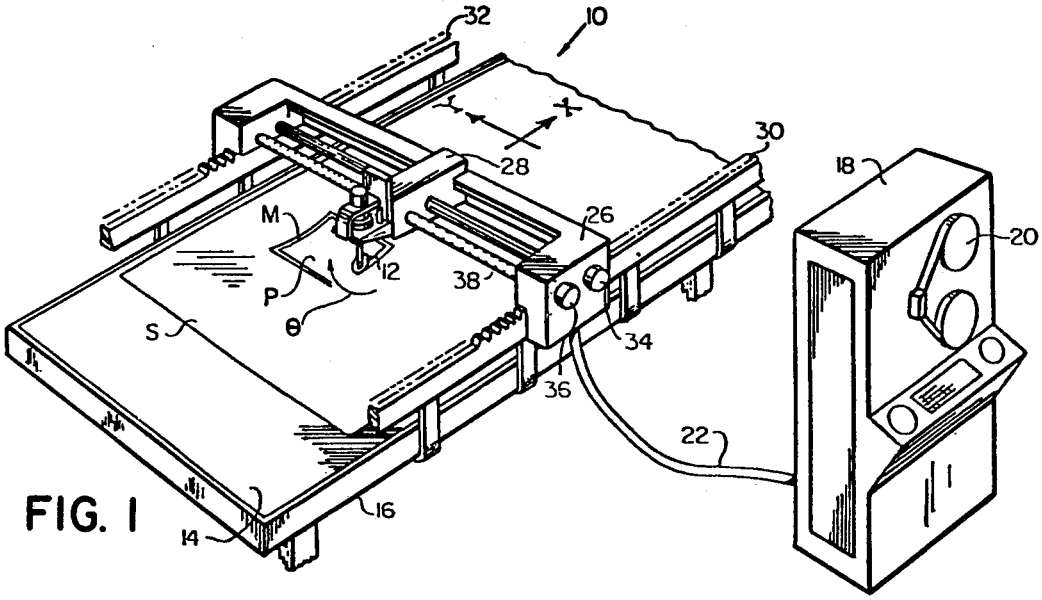
FIG. 1 is a perspective view of an apparatus used in the preparation of pattern pieces in accordance with a method of the present invention.

Referring now to the drawings, a method for preparing a pattern piece in accordance with the present invention is illustrated with reference to automatically controlled cutting machine shown in FIG. 1 and indicated generally by the reference numeral 10. The machine 10 includes a cutting instrument or cutting wheel 12 which rolls freely in cutting engagement with a sheet of material, designated by the letter S, spread on a smooth, hard, supportng surface 14 of a cutting table 16. The machine 10 is particularly adapted for cutting a single ply or a layup comprising a few plies of relatively thin sheet material arranged in stacked relation and positioned on the supporting or cutting surface 14. The machine operates in response to control signals received from a numerical controller 18 which guides the cutting wheel 12 along predetermined lines of cut to form pattern pieces which may, for example, comprise the component parts of a garment, such as a suit or shirt. The configuration of the lines of cut which define the periphery of the various pattern pieces are determined by a program tape 20 read by the controller 18. The controller outputs command signals which are transmitted to the cutting apparatus associated with the cutting table through a cable 22. In FIG. 1 a partially cut pattern piece is shown and indicated generally by the letter P.

The cutting wheel 12 is moved in cutting engagement with the sheet material S spread on the supporting surface 14 by a carriage assembly which includes an X carriage 26 and a Y carriage 28. The X carriage 26 is supported to translate in an X-coordinate direction longitudinally of the table 16 on a set of racks 30, 32 secured to the table and engaged by pinions (not shown) driven by an X-drive motor 34, which is energized by command signals received from the controller 18. The Y carriage 28 is mounted on the X carriage 26 for movement transversely of the table 16 in a Y-coordinate direction and moves in response to rotation of a lead screw 38 driven by a motor 36, which is also energized by command signals received from the controller. Coordinated movements of the carriages 26 and 28 translate the cutting wheel 12 along a predetermined cutting path over any area of the cutting surface 14.

Figure 2:
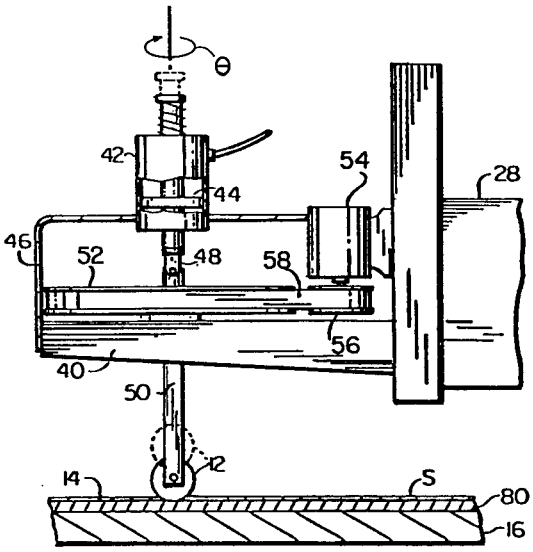
FIG. 2 is a somewhat enlarged fragmentary side elevational view of the machine of FIG. 1.

The illustrated cutting wheel 12 is further supported and arranged for movement generally toward and away from the cutting surface between a lowered or cutting position shown in full lines and a raised or inactive position indicated by broken lines in FIG. 2. The cutting wheel is also arranged for angular movement about a vertical axis in a $\theta$ coordinate direction.

Figure 3:
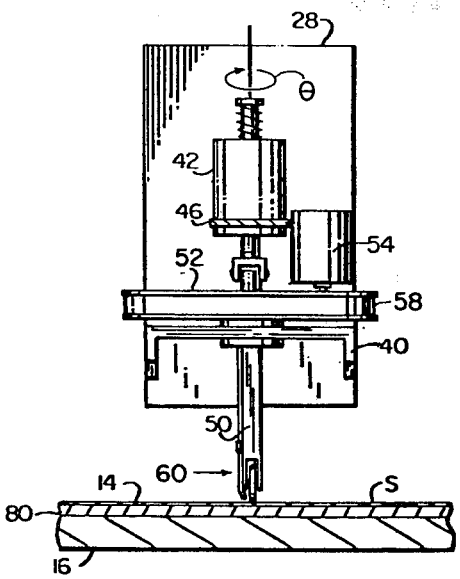
FIG. 3 is a fragmentary front elevational view of the machine of FIG. 1.

As best shown in FIGS. 2 and 3, the cutting wheel 12 is suspended below a platform 40 which projects from the Y carriage 28. The illustrated suspension system includes a fluid motor or actuator 42, which may be pneumatically or hydraulically operated. The actuator 42 is mounted on a frame 46 secured to the platform 40 and includes a piston and rod assembly 44 connected to the wheel 12 through a swivel connection 48 and a square drive rod 50. The cutting wheel 12 is journalled in the bifurcated lower end of the square drive rod 50 which is slidably engaged with a toothed pulley 52 coupled to a $\theta$ drive motor 54 by another toothed pulley 56 and a drive belt 58. The $\theta$ drive motor 54 operates in response to command signals from the controller 18 to move the cutting wheel in the $\theta$ coordinate direction. The swivel connection 48 allows the drive rod to rotate independently of the piston 44, but lifts and lowers the rod through the pulley 52.

Further disclosure of a sheet material cutting apparatus of the aforedescribed general type is found in the copending application of Heinz Joseph Gerber and David R. Pearl on METHOD AND APPARATUS FOR CUTTING SHEET MATERIAL WITH A CUTTING WHEEL, Ser. No. 168,312, filed July 10, 1980, which is hereby adopted by reference as part of the present disclosure.

Figure 4:
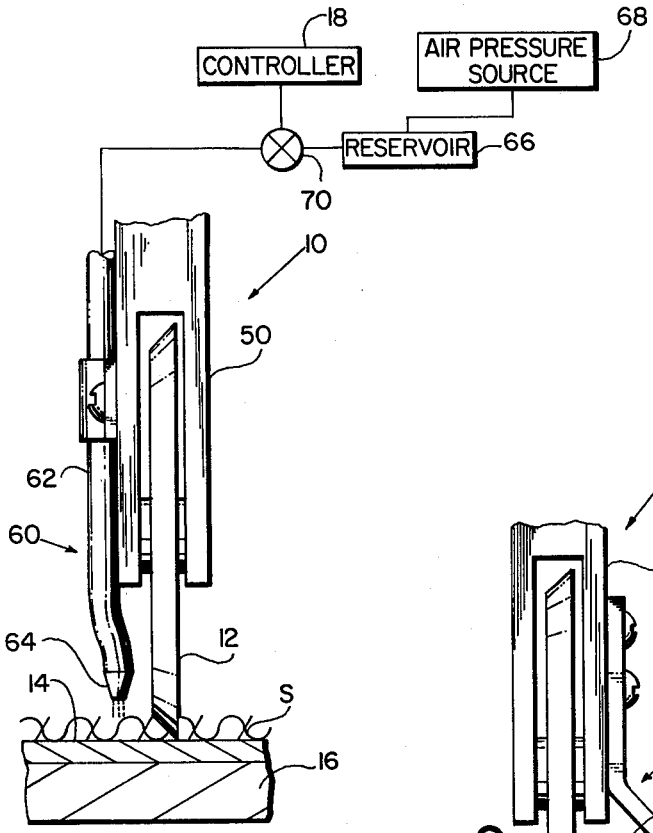
FIG. 4 is a somewhat enlarged fragmentary front elevational view of the apparatus as it appears in FIG. 3.
Figure 5:
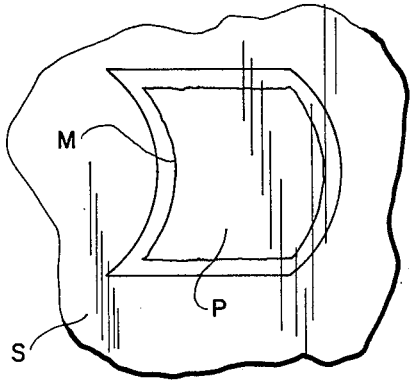
FIG. 5 is a plan view of a pattern piece prepared in accordance with a method of the present invention.

Referring now particularly to FIG. 4, in accordance with a method of the present invention, a substance is applied to the material along at least a substantial portion of the outline of the cut pattern piece to facilitate separation of the cut pattern piece from adjacent scrap material. The substance may, for example, comprise a marking material used to delineate the pattern piece, so that it is readily distinguishable from adjacent scrap material or it may comprise adhesive employed in a further method for physically separating the pattern piece from the scrap material, as will be hereinafter further discussed. Consequently, the illustrated apparatus 10 includes an applicator indicated generally at 60 for ejecting a fluid substance onto the sheet material adjacent and in generally parallel relation to the line of cut formed in the sheet material by the moving cutting wheel 12. The applicator 60 essentially comprises a fluid conduit 62 terminating at a nozzle 64 adjacent an associated side of the cutting wheel proximate the cutting edge of the wheel. The substance, such as a marking fluid, is supplied to the conduit 62 under pressure from a reservoir 66 pressurized by an air pressure source 68. Preferably, and as shown, a control valve 70 in the supply conduit 62 regulates the rate of flow of marking fluid from the conduit and/or interupts the flow of fluid ejected from the nozzle 64. The control valve 70 operates in response to signals received from the controller 18 so that the sheet material is marked only when the cutter is moving in cutting engagement with the material to form a pattern piece P. The marking fluid may be applied to either the pattern piece or the scrap material produced by the cutting operation. In the illustrated apparatus 10, the cutting wheel 12 normally advances in a clockwise direction around the outline of a pattern piece P, as viewed from above, and it should be noted that the applicator 60, viewed from the front and as it appears in FIG. 4, is located to the left of the cutter wheel 12. Thus, as the cutting wheel 12 advances in a clockwise direction in accordance with a predetermined program to cut the pattern piece P marking substance, indicated by the letter M, is simultaneously applied to a marginal portion of the cut pattern piece, as shown in FIG. 5.

Figure 7:
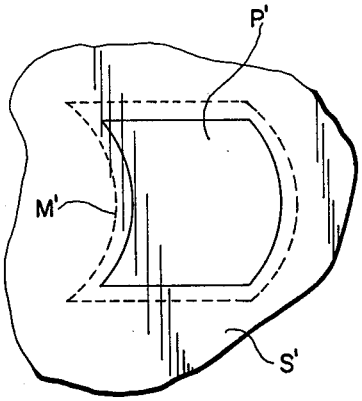
FIG. 7 is similar to FIG. 5, but illustrates a pattern piece prepared in accordance with the method illustrated in FIG. 6.
Figure 6:
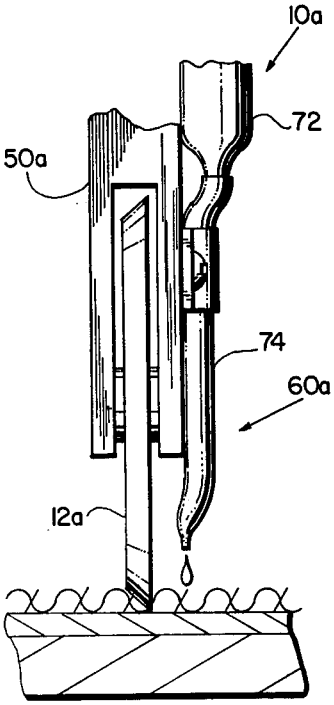
FIG. 6 is similar to FIG. 4 but shows another apparatus which illustrates another method for preparing a pattern piece.

In FIG. 6 there is shown another apparatus, indicated generally at 10*a*, which includes a gravity fed applicator 60*a* for simultaneously dripping a fluid substance such as a marking fluid or adhesive, onto a sheet of material as the material is cut. The fluid is applied along an interrupted line, which extends along at least a substantial portion of the outline of the cut pattern piece, so that the cut piece is readily discernible to facilitate its separation from adjacent scrap material. The applicator 60*a* includes a fluid reservoir 72 and a drip tube 74 which communicates with the latter reservoir and which has a fluid outlet disposed in close proximity to one side of the cutting wheel 12*a*. The rate at which fluid drips from the applicator 60*a* is determined by the viscosity of the fluid and the physical characteristics of the drip tube 74. However, if desired, a control valve or other appropriate means (not shown) may be provided for controlling drippage of fluid from the drip tube, so that fluid drips onto the sheet material only during the pattern piece cutting operation and then at a controlled rate. The applicator 60*a*, as viewed from the front and as it appears in FIG. 6, is located to the right of the cutting wheel 12*a*. Thus, as the cutting wheel 12*a* advances in a clockwise direction, as viewed from above, to cut a pattern piece an interrupted line of fluid is applied to the sheet material scrap adjacent the pattern piece. In FIG. 7 is a typical pattern piece delineated in the aforedescribed manner is indicated at P'. Fluid applied to the sheet material S' forms an interrupted or broken line M' around the pattern piece P' generally parallel to the edges of the piece.

In the aforedescribed apparatus for practicing the invention, the cutting wheel advances only in clockwise direction, as viewed from above, in cutting a pattern piece, therefore, a single applicator is mounted laterally of the cutting wheel at one or the other side thereof, as required, to apply a substance either to the pattern piece being cut or to the adjacent scrap material. However, if the invention is practiced with an apparatus wherein the cutting wheel is arranged to advance in either clockwise and/or counterclockwise direction during the cutting cycle, applicators may be mounted at both sides of the cutting wheel and suitable means, such as a control valve operated by the controller, may be provided for operating one or the other of the applicators, as required, to maintain application continuity during the pattern piece forming operation.

In accordance with the methods hereinbefore described, a substance is applied to the sheet material simultaneous with the cutting operation, however it should be understood that the cutting and substance applying operations may be separately performed. Thus, for example, an applicator may be mounted on the carriage assembly for applying a substance to sheet material in accordance with a predetermined program either before or after pattern pieces have been cut from it.

Figure 8:
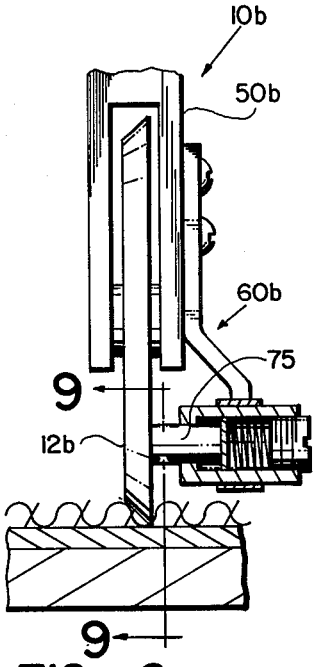
FIG. 8 is also similar to FIG. 4 but shows yet another apparatus which illustrates another method for preparing a pattern piece.
Figure 9:
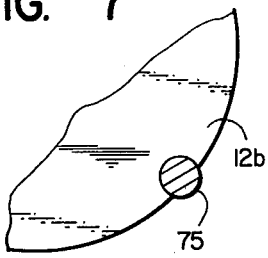
FIG. 9 is a sectional view taken along the line 9—9 of FIG. 8.

In some instances, it may be desirable to apply a substance such as marking material or the like directly along the line of cut formed in the sheet material by the cutting wheel. In FIGS. 8 and 9 there is shown another apparatus 10*b* which includes an applicator or marking device 60*b* for applying a solid or semi-solid marking substance 75, such as chalk or crayon, directly to a side face of the cutting wheel 12*b* and at the peripheral edge of the wheel as the cutting wheel moves in rolling engagement with the cutting surface 14. The marking substance is transferred by the wheel to the sheet material, being applied to the material along the kerf or cut formed in the material.

Further, and in accordance with the invention, a method is provided for automatically picking up cut pattern pieces to separate the cut pieces from adjacent scrap material. In accordance with the broad concept of this method an adhesive substance is applied to either the pattern pieces or the scrap material along at least a substantial portion of the outline of each pattern tern piece. After the adhesive substance has been applied, a pickup surface is moved into adhering engagement with the adhesive to effect pickup.

Figure 10:
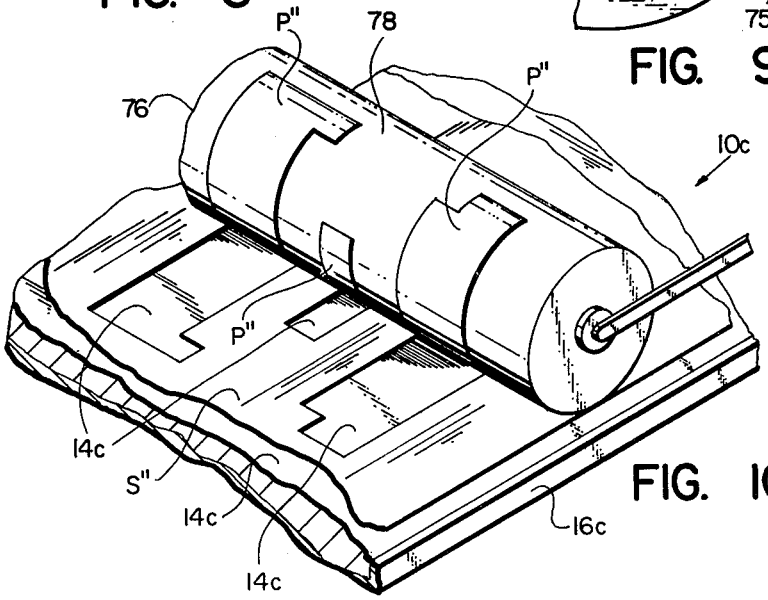
FIG. 10 is a fragmentary perspective view of still another apparatus which illustrates a further method of the invention.

In FIG. 10 there is shown somewhat schematically, an apparatus 10*c* which essentially comprises a modified form of the apparatus 10 previously described. However, the apparatus 10*c* includes a pickup roller 76 which defines a cylindrical pickup surface 78. The roller 76 is arranged to move with the X-Y carriage assembly and in trailing relation to it so that the pickup surface 78 moves into adhering engagement with the adhesive applied to each cut pattern piece P″ as the roller advances with the advancing carriage assembly and rolls over the pattern piece. Upon completion of the cutting operation the finished pattern pieces may be peeled away from the pickup roller 76.

If the scrap material is to be picked up by the roller leaving the cut pattern pieces on the cutting table, the adhesive is, of course, applied to the scrap material rather than to the pattern pieces.

I claim:

1. A method for preparing a pattern piece from sheet material comprising the steps of spreading at least one sheet of material on a supporting surface, moving a cutting instrument in cutting engagement with the spread material in response to a predetermined cutting program to cut the pattern piece from the sheet material, simultaneously applying adhesive to the cutting instrument as the instrument is moved in cutting engagement with the sheet material and transferring the substance from the moving cutting instrument to one of the parts of the sheet material which includes the pattern piece and the scrap material adjacent the pattern piece, moving a pickup surface into engagement with the applied adhesive, and picking up the one part with the pickup surface.

2. A method for preparing a pattern piece as set forth in claim 1 wherein the step of moving a cutting instrument is further characterized as moving a rotary cutter having a circular peripheral cutting edge in rolling engagement with the supporting surface.

3. A method for preparing a pattern piece as set forth in claim 2 wherein the step of applying adhesive is further characterized as applying adhesive to a side face of the rotary cutter proximate the peripheral edge thereof.

4. A method for preparing a pattern piece as set forth in either claim 1 or claim 3 wherein the step of applying adhesive is further characterized as applying adhesive to the scrap material adjacent the pattern piece.

5. A method for preparing a pattern piece as set forth in either claim 1 or claim 3 wherein the step of applying adhesive is further characterized as applying adhesive to the pattern piece.

6. A method for preparing a pattern piece as set forth in claim 1 wherein the step of applying adhesive is further characterized as ejecting adhesive onto the sheet material.

7. A method for preparing a pattern piece as set forth in claim 1 wherein the step of moving a pickup surface is further characterized as rolling a pickup roller defining a pickup surface over the applied adhesive.

8. A method for preparing a pattern piece from sheet material comprising the steps of spreading at least one sheet of material on a supporting surface, moving a cutting instrument in cutting engagement with the spread material in response to a predetermined cutting program to cut the pattern piece from the sheet material, applying adhesive to one of the parts of the sheet material which includes the pattern piece and the scrap material adjacent the pattern piece, moving a pickup surface into adhering engagement with the applied adhesive, and picking up the one part with the pickup surface.

9. A method for preparing a pattern piece as set forth in claim 8 wherein the step of applying an adhesive is performed simultaneously with the step of moving a cutting instrument.

10. A method for preparing a pattern piece as set forth in either claim 8 or claim 9 wherein the step of applying adhesive is further characterized as ejecting adhesive onto one of the parts.

11. A method for preparing a pattern piece as set forth in either claim 8 or claim 9 wherein the step of applying adhesive is further characterized as dripping adhesive onto one of the parts.

12. A method for preparing a pattern piece as set forth in either claim 8 or claim 9 wherein the one part comprises the pattern piece.

13. A method for preparing a pattern piece as set forth in either claim 8 or claim 9 wherein the one part comprises the scrap material.

14. A method for preparing a pattern piece as set forth in either claim 8 or claim 9 wherein the step of moving a pickup surface is further characterized as rolling a pickup roller defining a pickup surface over the applied adhesive.

* * * * *